US012410663B2

(12) United States Patent
Provost et al.

(10) Patent No.: US 12,410,663 B2
(45) Date of Patent: Sep. 9, 2025

(54) COMPLETION STRING, METHOD, AND SYSTEM

(71) Applicant: Baker Hughes Oilfield Operations LLC, Houston, TX (US)

(72) Inventors: Wilfred Provost, Tomball, TX (US); Herb Dhuet, Richmond, TX (US); Michael Johnson, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/463,871

(22) Filed: Sep. 8, 2023

(65) Prior Publication Data

US 2025/0084710 A1 Mar. 13, 2025

(51) Int. Cl.

| | |
|---|---|
| ***E21B 17/06*** | (2006.01) |
| ***E21B 23/04*** | (2006.01) |
| ***E21B 34/12*** | (2006.01) |
| ***E21B 43/10*** | (2006.01) |

(52) U.S. Cl.

CPC ..... *E21B 17/06* (2013.01); *E21B 23/04* (2013.01); *E21B 34/12* (2013.01); *E21B 43/10* (2013.01)

(58) Field of Classification Search

CPC ..... E21B 34/12; E21B 43/10; E21B 23/04; E21B 17/06

See application file for complete search history.

(56) References Cited

U.S. PATENT DOCUMENTS 4,043,392 A 8/1977 Gazda
2006/0219413 A1 10/2006 Vilela et al.
2013/0062066 A1* 3/2013 Broussard ..... E21B 34/06 166/305.1
2021/0372204 A1 12/2021 Patel
2023/0055946 A1 2/2023 Macin Moreno et al.

FOREIGN PATENT DOCUMENTS

WO 2019172780 A1 9/2019

OTHER PUBLICATIONS

Notification of Transmittal of the International Search Report and the Written Opinion; PCT/US2024/045452; Korean Intellectual Property Office; Mailed Dec. 19, 2024; 11 pages.

* cited by examiner

*Primary Examiner* — Robert E Fuller
(74) *Attorney, Agent, or Firm* — Baker Hughes Patent Organization

(57) ABSTRACT

A completion string, including an upper completion having a shifting tool, and a lower completion having a hydraulic releaser and a valve responsive to the shifting tool. A method for completing a well, including running the completion string in a borehole, establishing pressure integrity, applying tubing pressure to release the hydraulic releaser, and shifting the valve. A method for completing a well, including running an upper completion connected to a lower completion into a borehole, releasing a hydraulic releaser with applied tubing pressure, and shifting a valve in the lower completion with movement of the upper completion. A wellbore system, including a borehole in a subsurface formation, an upper completion and a lower completion in the borehole, a hydraulic releaser connecting the upper completion to the lower completion, the hydraulic releaser being responsive to applied tubing pressure to releaser the upper completion from the lower completion.

15 Claims, 13 Drawing Sheets

COMPLETION STRING, METHOD, AND SYSTEM

BACKGROUND

In the resource recovery and fluid sequestration industries there is often need for what are known as lower completions and upper completions. These are generally run separately and manipulated using shear up or shear down processes to render the completions fit to convey fluid or be separated for other operations. Shear up/shear down works reasonably well but leaves some efficiencies off the table. The art is always receptive to efficiency increasing technologies.

SUMMARY

An embodiment of a completion string, including an upper completion having a shifting tool, and a lower completion having a hydraulic releaser and a valve responsive to the shifting tool.

An embodiment of a method for completing a well, including running the completion string in a borehole, establishing pressure integrity, applying tubing pressure to release the hydraulic releaser, and shifting the valve.

An embodiment of a method for completing a well, including running an upper completion connected to a lower completion into a borehole, releasing a hydraulic releaser with applied tubing pressure, and shifting a valve in the lower completion with movement of the upper completion.

An embodiment of a wellbore system, including a borehole in a subsurface formation, an upper completion and a lower completion in the borehole, a hydraulic releaser connecting the upper completion to the lower completion, the hydraulic releaser being responsive to applied tubing pressure to releaser the upper completion from the lower completion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
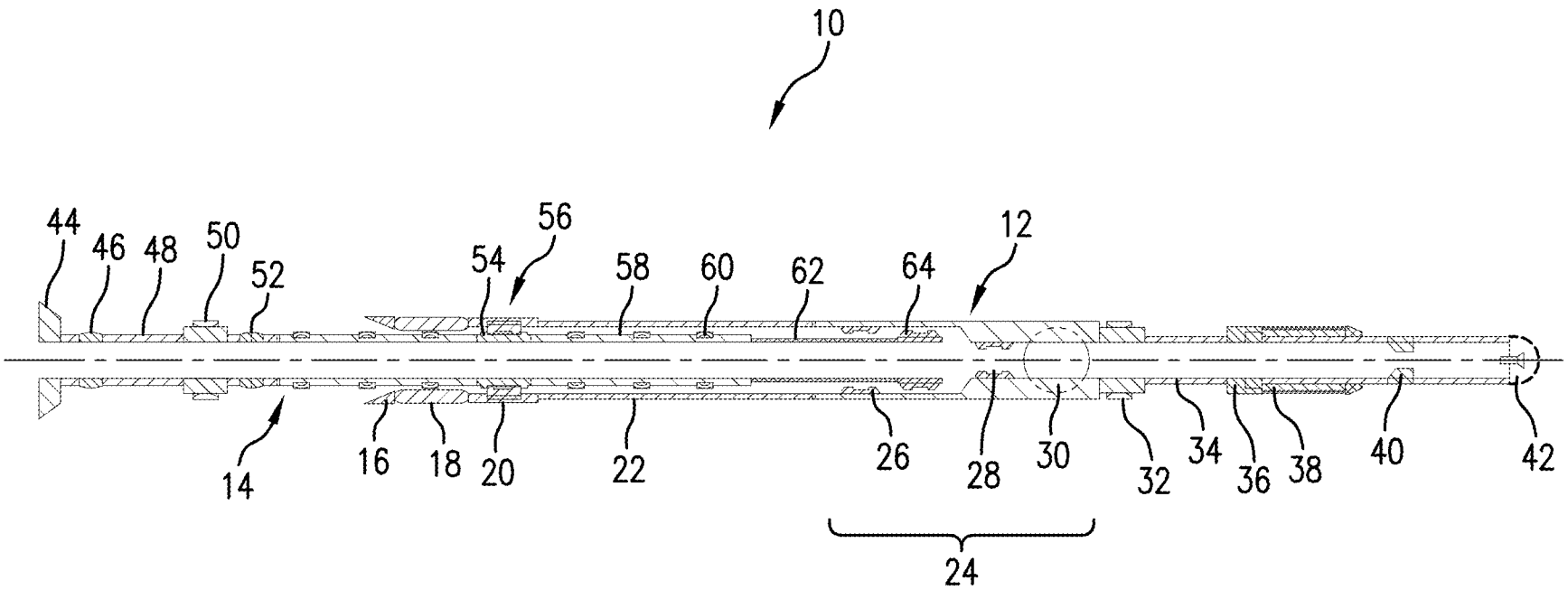
FIG. 1 is a sectional view of a completion as disclosed herein.

FIG. 1 is an overview of the completion 10 as disclosed herein that provides a frame of reference for the disclosure. Completion 10 includes a lower completion 12 and an upper completion 14. The upper completion nests radially inwardly with the lower completion 12 when the two are connected. The lower completion may include, in embodiments, an entry guide 16, a seal bore 18, a hydraulic release module 20, a tubing space out joint (TSOJ) housing 22, a lower completion tubing valve assembly 24, (which itself includes a one-way profile 26, a valve profile 28 distinct from the one-way profile 26, and a valve 30), a lower completion packer/anchor 32, a lower completion tubing 34, a lower completion radial valve 36, a screen 38, a toe valve 40 (well isolation valve), and a float shoe 42. The upper completion 14 may include, in embodiments, a tubing hanger 44, a safety valve 46, an upper completion tubing 48, an upper completion packer 50, a circulating valve 52, a hydraulic release sub 54 (which is interactive with the hydraulic release module 20 and together therewith forms a hydraulic releaser 56), a seal mandrel 58, a number of seals 60, a washpipe 62, and a one-way shifter profile 64. Each of the components listed for the lower completion 12 and upper completion 14 are connected as illustrated in FIG. 1.

The completion 10 is runnable to target depth in a connected form in one run and then may be manipulated to release the upper completion 14 from the lower completion 12 in order to stroke the upper completion. While that statement in itself is not new, taking this action via a hydraulic releaser 56 and allowing uphole direction and downhole direction movement of the upper completion relative to the lower completion is not found in the art. Traditionally, a shear up or shear down is needed where no such action is required in the completion 10 disclosed herein. Rather, efficiency is dramatically improved by configuring the completion 10 to respond to a hydraulic input to release the upper completion 14 from the lower completion 12. This configuration facilitates conveyance of the completion into a wellbore with high axial loads that might prematurely activate a prior art shear-type release mechanism. In this context, "high" means upwards of about 50,000 pounds. The configuration also facilitates uphole direction and downhole direction movement options. This enables placing the tubing hanger 44 in a precise predetermined location, while placing the lower completion 12 in a variable location to react to varying conditions in the lower wellbore. Incorporating the shifter 64 in the upper completion facilitates efficient closing of the valve 30 with movement of the upper completion. At the conclusion of operations, the upper completion 14 is permanently installed and not removed from the well since with the configuration as disclosed does not employ a temporary workstring (that would have to be removed from the well) like the prior art does thereby enabling greater efficiency of the present disclosure.

Figure 2:
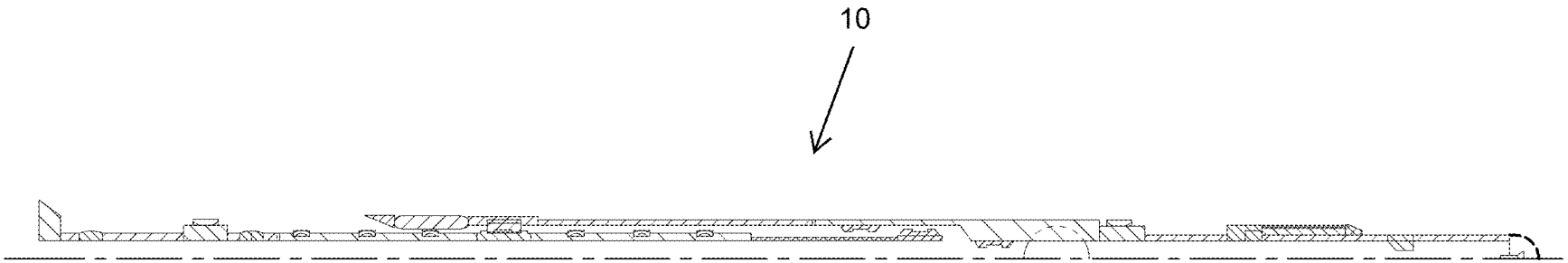
FIGS. 2-8 are views of the same completion is various operational positions.
Figure 3:
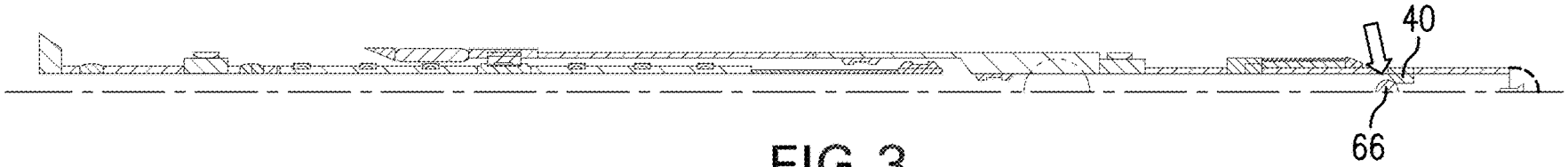
Figure 4:
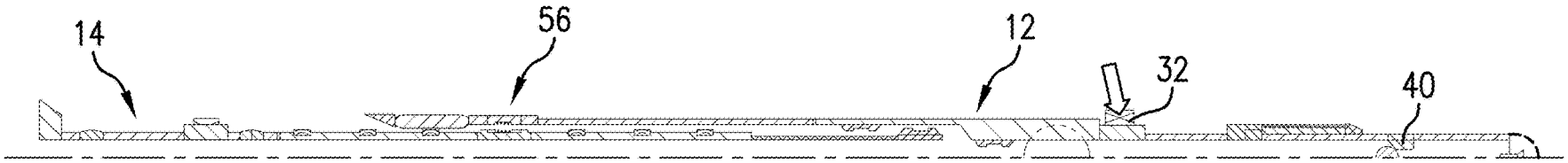
Figure 5:
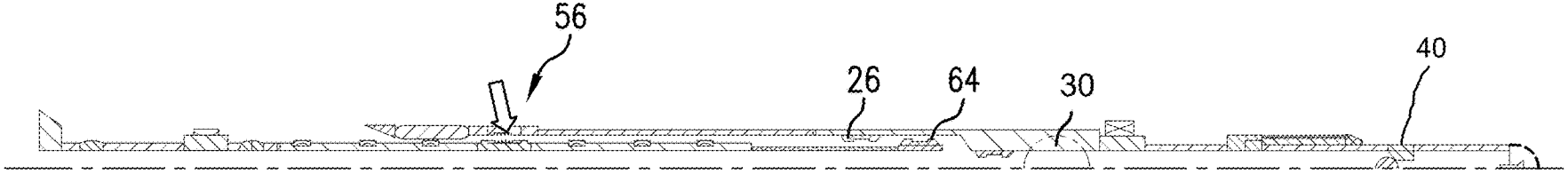
Figure 6:
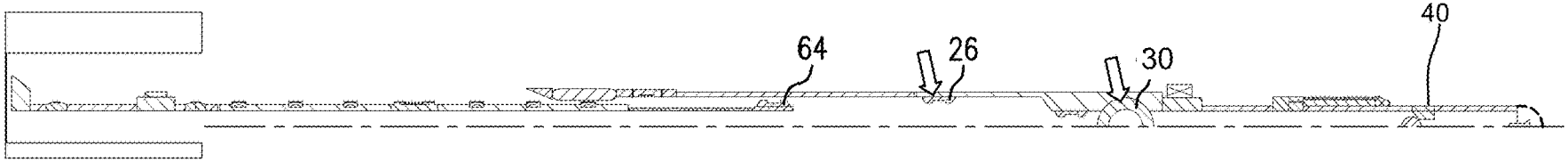
Figure 7:
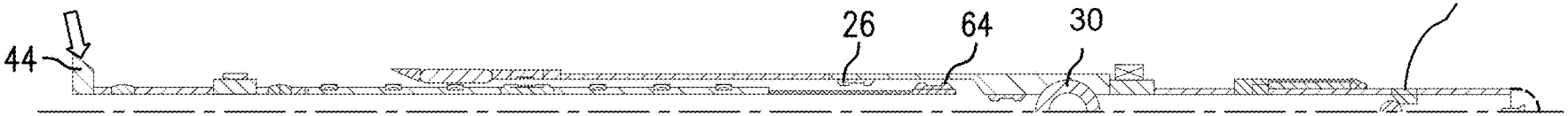
Figure 8:
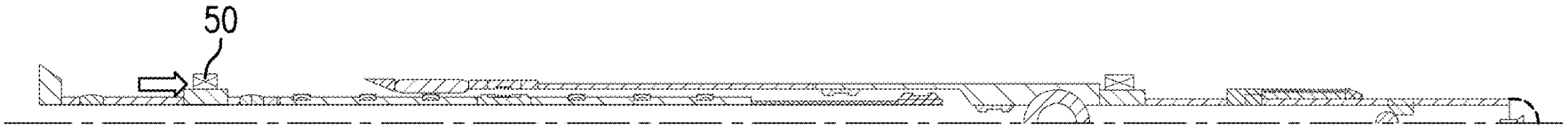

Referring to FIGS. 2-8, a sequence of operations is illustrated with the lower completion generally maintained in position so that moving components are easy to appreciate. It will be appreciated that FIG. 2 is very similar to FIG. 1. This is the way that completion 10 is run in the hole. Once the completion is at target depth in a borehole 92 (see FIG. 14), an object 66 (FIG. 3) is released into the completion 10 to land on the toe valve or well isolation valve seat 40. Pressure integrity is established and pressure applied to tubing or to annulus may be used to set the lower completion packer 32. It is the differential in tubing and annulus pressure that causes the set sequence in ways that are known in the art. Once the packer 32 is set (FIG. 4), the pressure differential is increased to activate the hydraulic releaser 56, which eliminates the axial and rotational lock between the lower completion 12 and the upper completion 14 (FIG. 5). Once the releaser 56 releases, it is possible to pick up on the upper completion 14 leaving the lower completion 12 in place (and anchored by the packer 32). Picking up on the upper completion 14 (FIG. 6) allows the shifter profile 64 to shift the valve 30 to a closed position by engaging and moving profile 26. It is to be understood that shifter profile 64 only engages and moves the profile 26 in a single direction, that direction associated with the closing of the valve 30. Shifter profile 64 interacting with the profile 26 in the valve open direction will simply bump past and not engage. The upper completion may then be set down with slack off weight to land the tubing hanger 44 (FIG. 7). Finally, tubing pressure is applied to set the upper completion packer 50.

Figure 9:
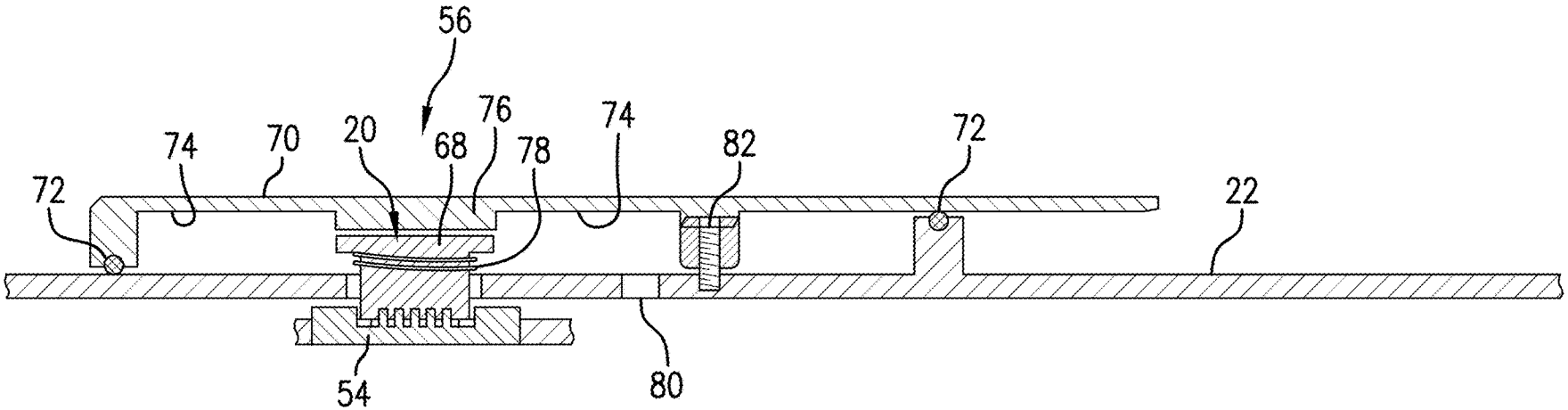
FIGS. 9-11 are views of the hydraulic releaser as disclosed herein in various operational positions.
Figure 10:
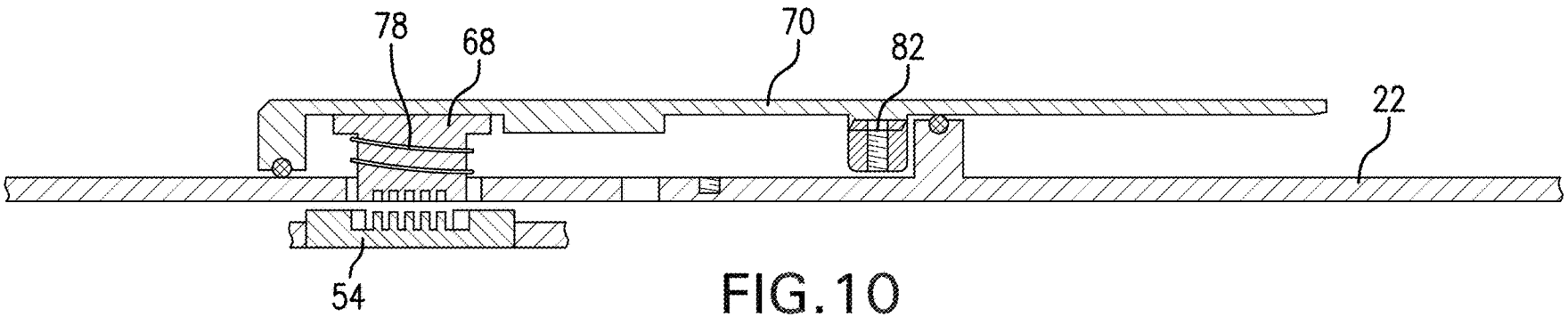
Figure 11:
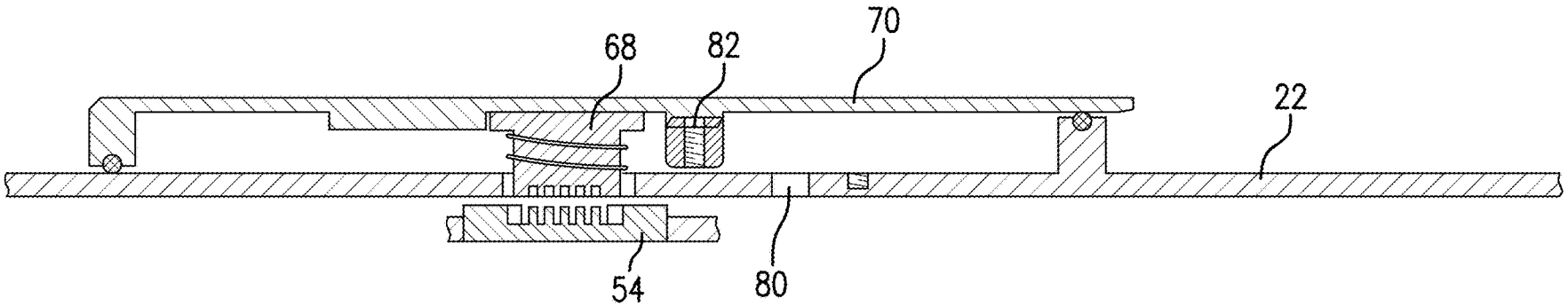
Figure 12:
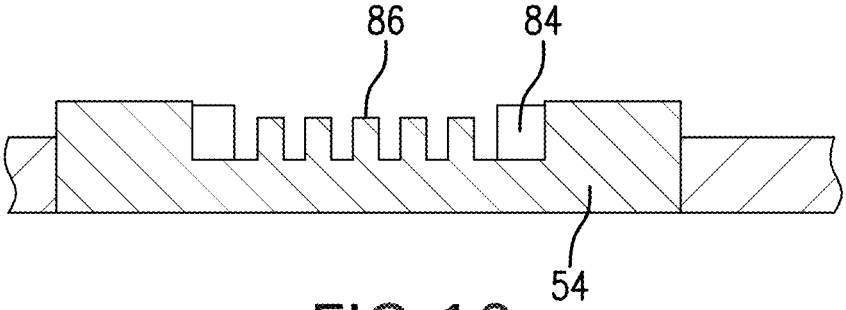
FIG. 12 is a sectional view of a hydraulic releaser profile.
Figure 13:
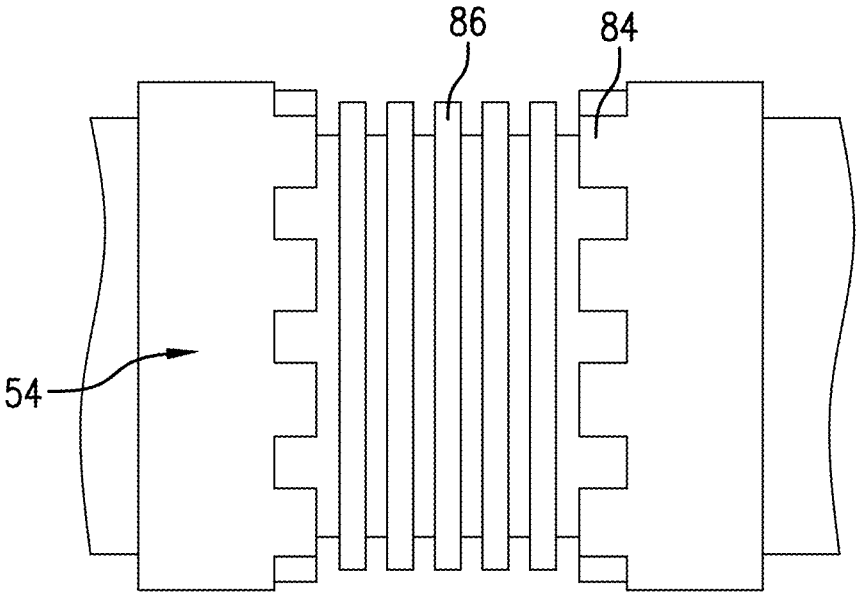
FIG. 13 is a side view of the hydraulic releaser profile.

Referring to FIGS. 9-11, an enlarged view of the hydraulic releaser 56 is illustrated. It will be appreciated that a dog 68 extends through the tubing space out joint housing 22 into contact with the hydraulic release sub 54. As such, the upper completion 14 and lower completion 12 are axially and rotationally affixed to one another. The dog 68 is maintained in this position by a releaser housing 70 that is sealed to the TSOJ housing 22 but movable thereon in response to applied pressures. Seals 72 are illustrated having different diameters to respond to differential pressures from either the tubing to annulus or annulus to tubing. The housing 70 includes recesses 74 on either side of a holder 76 such that movement of the housing 70 in either longitudinal direction of the completion 10 will result in the dog 68 being unlocked and a biaser 78 moving the dog 68 radially outwardly into either recess 74. As noted, the movement of the housing 70 is due to pressure, that pressure being applied through port 80 in TSOJ housing 22. In some embodiments, the releaser 56 will include a shear member 82 or equivalent to hold the housing 70 in position until a threshold pressure differential is attained across seals 72. In the released position, illustrated in FIGS. 10 and 11 (in differing longitudinal directions) it can be seen that the dog 68 and the hydraulic release sub 54 are no longer engaged, hence allowing freedom of movement between upper completion 14 and lower completion 12.

Referring to Figured 12 and 13, an enlarged view of the hydraulic release sub 54 is illustrated. The views illustrate castellations 84 for rotational locking and castellations 86 for axial locking.

Figure 14:
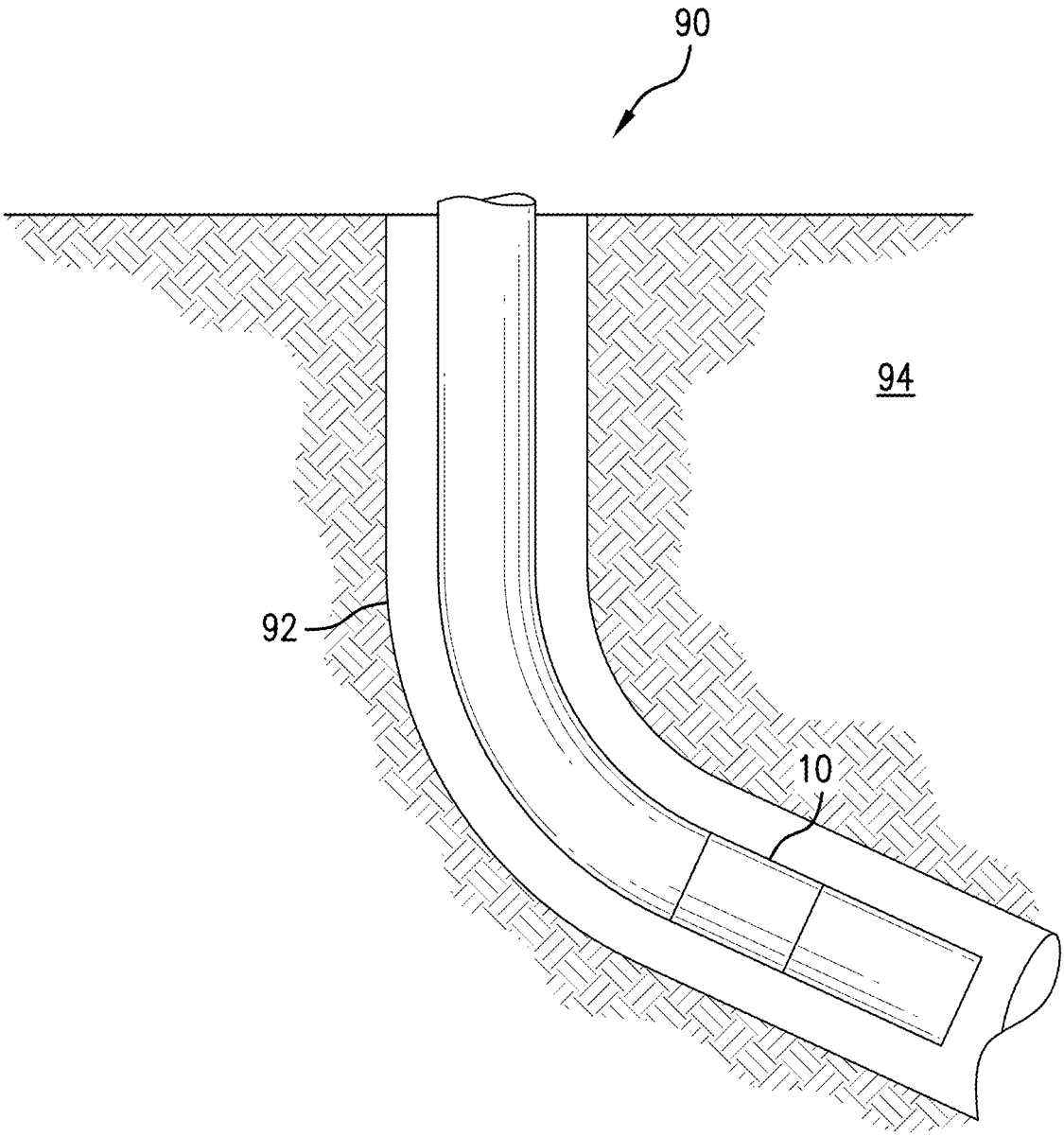
FIG. 14 is a view of a wellbore system including the completion as disclosed herein.

Referring to FIG. 14, a borehole system 90 is illustrated. The system 90 comprises a borehole 92 in a subsurface formation 94. A completion 10 as disclosed herein is disposed within the borehole 92.

Set forth below are some embodiments of the foregoing disclosure:

Embodiment 1: A completion string, including an upper completion having a shifting tool, and a lower completion having a hydraulic releaser and a valve responsive to the shifting tool.

Embodiment 2: The string as in any prior embodiment, wherein the hydraulic releaser is downhole of a seal bore in the lower completion.

Embodiment 3: The string as in any prior embodiment, wherein the hydraulic releaser locks the upper and lower completions together until released.

Embodiment 4: The string as in any prior embodiment, wherein upon release of the hydraulic release the upper completion is movable both in the uphole direction and downhole direction from the position where the upper completion was locked by the hydraulic releaser.

Embodiment 5: The string as in any prior embodiment, wherein the hydraulic releaser includes features that axially and rotationally lock the upper and lower completions relative to one another.

Embodiment 6: The string as in any prior embodiment, wherein the lower completion further includes a wellbore isolation valve.

Embodiment 7: The string as in any prior embodiment, wherein the hydraulic releaser is responsive to differential pressure inside the completion relative to pressure outside of the completion.

Embodiment 8: The string as in any prior embodiment, wherein the upper completion is configured to be permanently installed in a wellbore.

Embodiment 9: The string as in any prior embodiment, further comprising a lower completion tubing valve assembly that includes a one-way profile to open a valve of the assembly and a distinct valve profile to close the valve.

Embodiment 10: A method for completing a well, including running the completion string as in any prior embodiment in a borehole, establishing pressure integrity, applying tubing pressure to release the hydraulic releaser, and shifting the valve.

Embodiment 11: The method as in any prior embodiment, wherein the establishing pressure integrity includes dropping an object and seating the object in a seat in the lower completion.

Embodiment 12: The method as in any prior embodiment, wherein the applying pressure further includes setting a lower completion anchor.

Embodiment 13: The method as in any prior embodiment, wherein the shifting includes picking up on the upper completion.

Embodiment 14: The method as in any prior embodiment, further comprising landing a tubing hanger.

Embodiment 15: The method as in any prior embodiment, further including setting an upper completion packer with applied tubing pressure.

Embodiment 16: A method for completing a well, including running an upper completion connected to a lower completion into a borehole, releasing a hydraulic releaser with applied tubing pressure, and shifting a valve in the lower completion with movement of the upper completion.

Embodiment 17: The method as in any prior embodiment, further including permanently installing the upper completion in the well.

Embodiment 18: A wellbore system, including a borehole in a subsurface formation, an upper completion and a lower completion in the borehole, a hydraulic releaser connecting the upper completion to the lower completion, the hydraulic releaser being responsive to applied tubing pressure to releaser the upper completion from the lower completion.

Embodiment 19: The system as in any prior embodiment, wherein the upper completion includes a shifting tool and the lower completion includes a valve responsive to the shifting tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A completion string, comprising:

an upper completion having a shifting tool; and a lower completion having a hydraulic releaser and a valve responsive to the shifting tool, wherein the hydraulic releaser locks the upper and lower completions together until released.

2. The string as claimed in claim 1, wherein the hydraulic releaser is downhole of a seal bore in the lower completion.

3. The string as claimed in claim 1, wherein upon release of the hydraulic releaser the upper completion is movable both in the uphole direction and downhole direction from the position where the upper completion was locked by the hydraulic releaser.

4. The string as claimed in claim 1, wherein the hydraulic releaser includes features that axially and rotationally lock the upper and lower completions relative to one another.

5. The string as claimed in claim 1, wherein the lower completion further includes a wellbore isolation valve.

6. The string as claimed in claim 1, wherein the hydraulic releaser is responsive to differential pressure inside the lower completion relative to pressure outside of the lower completion.

7. The string as claimed in claim 1, further comprising a lower completion tubing valve assembly that includes a one-way profile to open the valve of the assembly and a distinct valve profile to close the valve.

8. A method for completing a well, comprising:

running the completion string as claimed in claim 1 in a borehole;

establishing pressure integrity;

applying tubing pressure to release the hydraulic releaser; and shifting the valve.

9. The method as claimed in claim 8, wherein the establishing pressure integrity includes dropping an object and seating the object in a seat in the lower completion.

10. The method as claimed in claim 8, wherein the applying pressure further includes setting a lower completion anchor.

11. The method as claimed in claim 8, wherein the shifting includes picking up on the upper completion.

12. The method as claimed in claim 8, further comprising landing a tubing hanger.

13. The method as claimed in claim 8, further including setting an upper completion packer with applied tubing pressure.

14. A method for completing a well, comprising:

running an upper completion locked to a lower completion by a hydraulic releaser into a borehole;

releasing the hydraulic releaser with applied tubing pressure; and shifting a valve in the lower completion with a shifting tool of the upper completion.

15. A wellbore system, comprising:

a borehole in a subsurface formation;

an upper completion having a shifting tool and a lower completion having a hydraulic releaser and a valve responsive to the shifting tool in the borehole;

a hydraulic releaser locking the upper completion to the lower completion until released, the hydraulic releaser being responsive to applied tubing pressure to releases the upper completion from the lower completion.

* * * * *